United States Patent [19]

Berman

[11] Patent Number: 4,521,474

[45] Date of Patent: Jun. 4, 1985

[54] CARRIER AND METHOD FOR PROVIDING YARN FOR LATCH HOOK RUG KITS AND THE LIKE

[76] Inventor: Edward Berman, 1080 South Downing St., Seaside, Oreg. 97138

[21] Appl. No.: 211,309

[22] Filed: Nov. 28, 1980

Related U.S. Application Data

[62] Division of Ser. No. 091,550, Nov. 5, 1979, abandoned.

[51] Int. Cl.[3] ..... B32B 3/02

[52] U.S. Cl. ..... 428/93; 428/95; 428/101; 428/105; 428/109; 428/131; 428/137; 428/255; 434/95

[58] Field of Search ..... 428/85, 93, 95, 96, 428/101, 131, 137, 138, 105, 109, 255; 156/172; 434/95; 28/147

[56] References Cited

U.S. PATENT DOCUMENTS 3,017,847 1/1962 Heen ..... 428/93

4,127,191 11/1978 Cave ..... 434/95

4,229,864 10/1980 Rankin ..... 28/147

*Primary Examiner*—James J. Bell

*Attorney, Agent, or Firm*—Chernoff, Vilhauer, McClung, Birdwell & Stenzel

[57] ABSTRACT

A carrier for holding pieces of yarn ready for use in making rugs and similar articles by hand comprises a perforated flexible sheet of pliable material such as strong paper. The ends of individual pieces of yarn of predetermined length extend through the perforations, with each piece of yarn bent into a "U" shape so that both ends of each piece are on the same side of the fabric sheet, but the two ends of each piece extend through different perforations. The pieces of yarn may be mechanically inserted into the sheet in locations corresponding to the locations of the pieces of yarn in the article to be made by hand, giving a preview of the appearance of the article and serving as a pattern for the handmade article.

6 Claims, 4 Drawing Figures

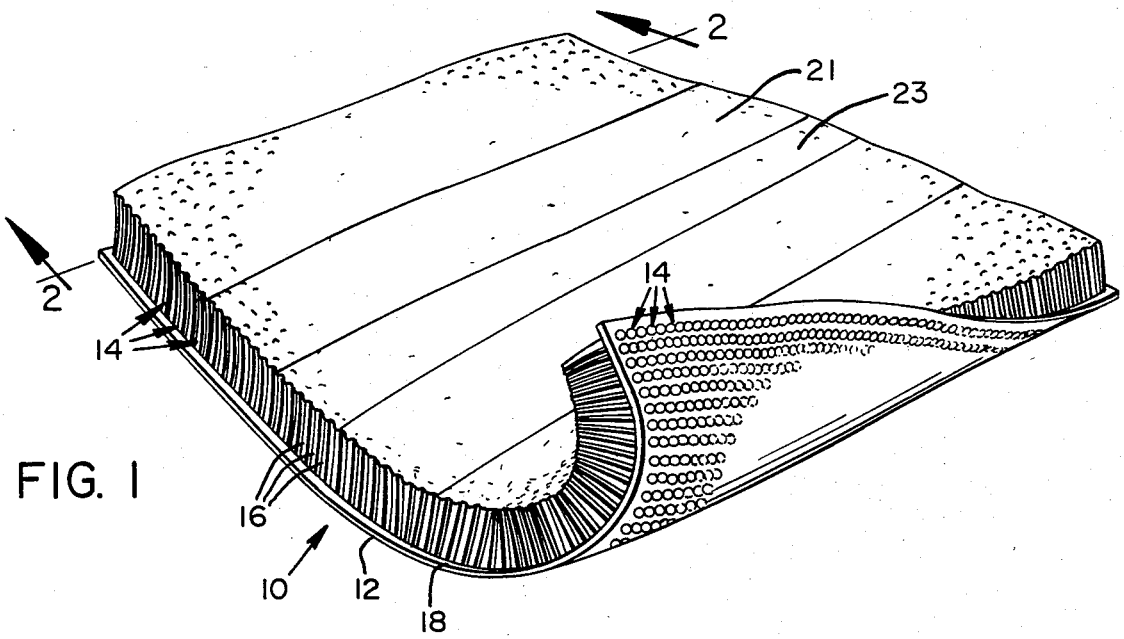
FIG. 1
FIG. 4
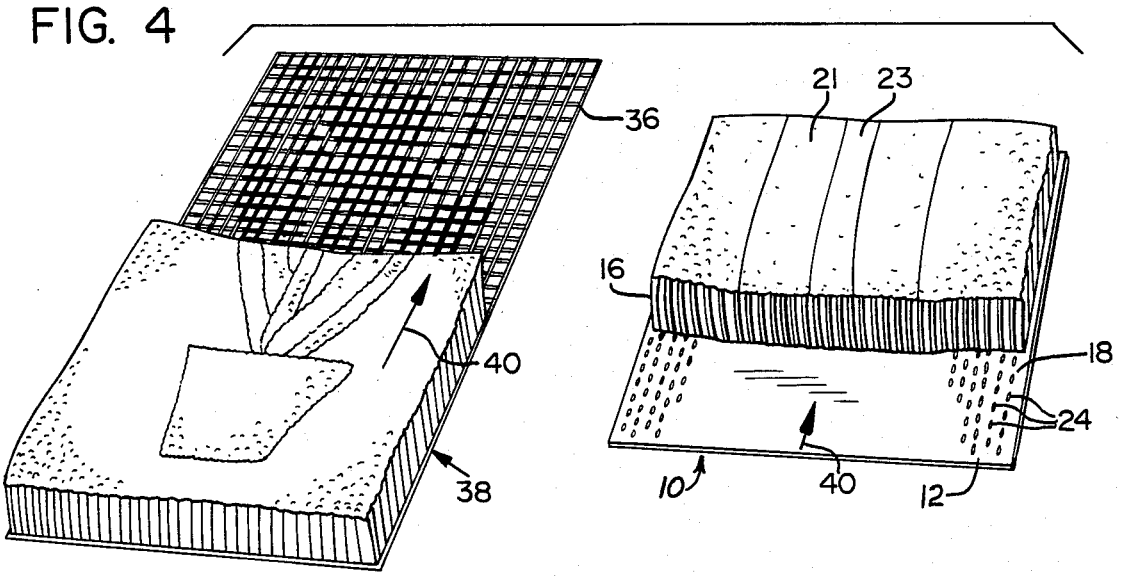
FIG. 2
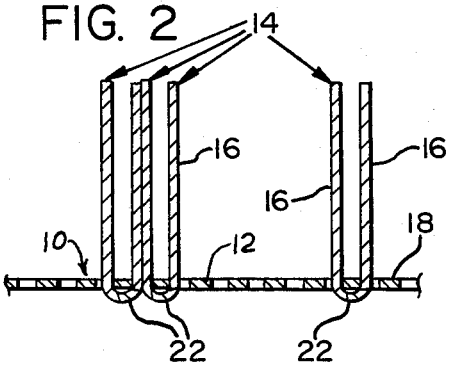
FIG. 3
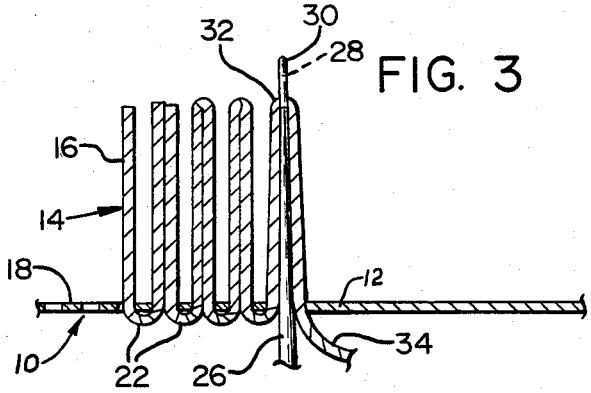

CARRIER AND METHOD FOR PROVIDING YARN FOR LATCH HOOK RUG KITS AND THE LIKE

This application is a division of application Ser. No. 091,550, filed Nov. 5, 1979 now abandoned.

BACKGROUND OF THE INVENTION

The present invention relates to a carrier for holding pieces of yarn and the like ready for use in making latch hook rugs and the like by hand.

Attractive rugs, wall hangings, pillow cases and the like can be made by tying short pieces of yarn of uniform length to the threads of a coarsely woven mesh backing material, leaving the ends of all of the pieces of yarn evenly aligned with one another on one side of the backing material. The preferred type of backing material is commercially available, and is often sold in kits which provide all of the necessary materials for making a complete rug or other article. In such kits, a pattern for the rug is often printed on the backing material, and various colors of yarn are provided so that a handicraft hobbyist may complete the kit by tying lengths of yarn to the mesh of the backing material. By following the pattern printed on the mesh the hobbyist can easily produce an intricate design in the finished article.

One such type of craft article is called a latch hook rug, because individual precut pieces of yarn are tied to the mesh backing material in a cowhitch or similar knot which may be most easily made with the use of a latch hook. Yarn is often provided in precut form in such kits, saving the hobbyist the time otherwise necessary to cut yarn into many individual pieces of uniform length. Such yarn, when packaged in precut form, is commonly wrapped in a bundle, with all of the yarns parallel to one another and their ends evenly aligned. Individual yarns are removed from the package when needed for tying into the mesh backing material. Although this type of package for the yarn is initially sufficient, it has several weaknesses. As pieces of precut yarn are removed, the yarn remaining in the package becomes looser and looser until the package no longer holds the yarn securely. As a result, the precut pieces of yarn may easily be spilled, making it difficult to work on a handicraft article of this sort in places such as buses, commuter trains, and the like, because of the likelihood of scattering the precut pieces of yarn.

In making latch hook rugs, each precut piece of yarn must be bent double before it is tied using the latch hook. Precut yarn is commonly packaged straight, requiring the hobbyist to bend each piece of yarn individually as he makes his handmade article. Additionally, such precut yarn is usually packaged in packets of standard sizes, which often provide too much of a particular color of yarn for a particular rug pattern, leading to wasted yarn.

While to some extent it is possible to gain an idea of the eventual appearance of a handmade article by observation of the pattern printed on a mesh backing in a kit, or from photographs of exemplary finished articles, the colors printed on the mesh material or seen in photographs rarely are exactly the colors of the yarn actually provided in a kit. As a result, it is often difficult to form a good idea of the eventual appearance of a latch hook rug or similar article by observing the contents of a kit.

What is needed, therefore, is a carrier for precut pieces of yarn which holds all of the pieces of yarn tightly enough to prevent loss but loosely enough for easy removal and without progressive loosening as additional pieces of yarn are removed. It is also desirable to provide in such a carrier a way of previewing the final appearance of the latch hook rug or similar article which may be made from a kit, while holding the yarn for such a kit so that it is already bent in a "U" shape.

SUMMARY OF THE INVENTION

In view of the foregoing shortcomings and disadvantages of previously known holders for short pieces of yarn, it is a primary objective of the present invention to provide an improved carrier for holding precut pieces of yarn in appropriate quantities ready for use in latch hook rug kits and similar handicraft articles.

It is another major objective of the present invention to provide a yarn carrier which holds each of a plurality of pieces of yarn securely, while allowing individual pieces to be easily removed from the carrier for use.

It is another objective of the present invention to provide a yarn carrier which provides pieces of yarn which are already crimped in a "U" shape for easy tying to the backing material for a latch hook rug.

It is a further objective of the present invention to provide a yarn carrier which holds precut pieces of yarn arranged in a stripe pattern giving easy access to yarns of each color required for a particular design, so that they may be selected and then tied to a mesh backing material to form a latch hook rug or similar article.

Accordingly, the present invention overcomes the shortcomings and disadvantages of previously known yarn carriers for precut pieces of yarn by providing a carrier which comprises a pliable sheet of material such as thin cloth, flexible sheet vinyl material, strong paper, or other sheet material comprising randomly oriented fibers, which holds the individual precut pieces of yarn already bent in a "U" shape. The carrier of the invention may be used to hold in one convenient article all the pieces of yarn of each color required by the pattern of the handicraft article of which they are intended to become a part.

Each end of each precut piece of yarn extends through a perforation in the sheet of material forming the carrier of the present invention. Each piece of yarn is held securely in a "U" shape in the carrier by friction between the sheet material and the yarn in two places on each piece of yarn. This allows each precut piece of yarn to be removed individually from the carrier.

The yarn may be inserted into the carrier before it is cut to predetermined length, by the use of a machine such as a carpet yardage machine, in which a plurality of needles perforate the carrier and simultaneously carry loops of yarn through the sheet material. The needles are then retracted, each needle leaving a loop of yarn extending through the perforation. Each loop is then cut off, leaving an end of each of two pieces of yarn extending through each individual perforation.

Use of such a machine with each individual needle serially forming a plurality of loops which are immediately cut results in each needle leaving a row of "U"-shaped precut pieces of yarn extending through the sheet material of the carrier. With appropriate needle spacing the rows are separated by a distance which allows the carrier to be folded between rows of pieces of yarn, giving convenient access to the pieces of yarn in any row selected.

While cloth may be used as the material of the carrier, it is preferable to use a non-woven material such as a bonded randomly oriented synthetic fiber material, or strong paper, since such material may, if desired, be torn or cut along each row of pieces of yarn as the pieces of yarn are serially removed.

It is therefore an important feature of the present invention that it provides a carrier which holds all of the yarn needed for completion of a handicraft article such as a latch hook rug conveniently ready for use.

It is another important feature of the present invention that individual perforations in the sheet material of the carrier hold each piece of yarn securely until that individual piece of yarn is needed, yet allow the piece of yarn to be easily removed.

It is a further feature of the present invention that individual perforations hold the individual precut pieces of yarn in a stripe which gives immediate access to each of the colors of yarn required by the design of a handmade latch hook rug or similar article.

It is an important advantage of the present invention that it securely carries each individual piece of precut yarn without progressively loosening and allowing pieces of yarn to be lost.

It is another advantage of the carrier of the invention that it provides a preview of the final appearance of all of the yarn types included in a handicraft kit.

It is a further advantage of the carrier of the invention that it holds each kind of yarn needed for completion of a handicraft kit article, in amounts required by the design of the article, without holding wastefully excessive amounts of some colors of yarn.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a pictorial view of an exemplary yarn carrier embodying the present invention, the yarn carrier being full of pieces of precut yarn.

FIG. 2 is a sectional view, at an enlarged scale, of a detail of the yarn carrier of FIG. 1, taken along line 2—2.

FIG. 3 is a sectional view, at an enlarged scale, of a detail of a yarn carrier embodying the invention, showing one manner of inserting yarn into the carrier.

FIG. 4 is a pictorial view of a yarn carrier embodying the present invention, along with a partially completed latch hook rug, showing the use of the yarn carrier of the invention.

DETAILED DESCRIPTION OF THE INVENTION

Referring now to FIGS. 1 and 2 of the drawings, a carrier 10 embodying the present invention may be seen to comprise a pliable sheet 12 through which extend a plurality of short pieces 14 of yarn bent into a "U" shape. The entire length of each leg 16 of the "U" shape of each piece 14 of yarn extends from the top side 18 of the sheet 12, and the base 22 of the "U" is on the second or bottom side 20 of the sheet 12. The pieces of yarn may be arranged advantageously by colors, as in the bands 21 and 23, as will be explained subsequently in greater detail.

The sheet 12 may be of any convenient pliable material which may be perforated to receive the yarn, but a flexible, lightweight and inexpensive, yet strong material is preferred for the sake of convenience. This allows the carrier to be bent, rolled, or folded to fit into a user's handbag or the like without being torn apart. While cloth is useable, a non-woven fabric, such as a tough yet flexible fabric of bonded randomly oriented fibers is preferred. One suitable material, for example, is a non-woven fabric of bonded synthetic fibers manufactured by E. I. DuPont de Nemours & Co., of Wilmington, Del., under the trademark Typar.

Referring particularly to FIG. 2, it may be seen that in a preferred embodiment of the invention the individual pieces 14 of yarn extend through closely spaced perforations 24 in the sheet 12, with adjacent pieces 14 of yarn sharing perforations. One leg 16 of each of two adjacent pieces 14 of yarn thus extends through each perforation in the sheet 12. This permits removal of an individual piece 14 of yarn without unduly disturbing the remaining piece 14 extending through a given perforation. Since each piece 14 of yarn extends through two perforations 24 in the sheet 12, sufficient friction is provided to hold each piece 14 of yarn until it is individually removed from the yarn carrier 10 of the invention.

Referring now also to FIG. 3, it may be seen that yarn may be inserted into the carrier 10 with the use of a needle 26 having an eye 28 near its pointed end 30. The pointed end 30 of the needle 26 is used to perforate the sheet 12 at the same time that it carries a loop 32 of a length of yarn 34 through the sheet 12. The needle 26 can then be withdrawn, leaving the loop 32 extending through the sheet 12. A predetermined amount of the length of yarn 34 is then pulled through the eye 28 of the needle as it again perforates the sheet 12 a predetermined distance from the previous perforation. Each of the loops 32 may be cut to separate the length of yarn 34 into individual pieces 14 such that the legs 16 extend away from the sheet 12 a predetermined distance. This process may be continued until a desired number of loops 32 have been made.

By using a carpet yardage machine programmed to use a plurality of similar needles 26 simultaneously, pieces 14 of yarn may be quickly fastened in the carrier 10 in amounts of each color of yarn corresponding to the requirements for the finished handmade latch hook rug or similar article. Thus certain needles 26 may provide pieces of yarn of one color to create the band 21, and another group of needles may provide yarn of another color to make the band 23, and so on. By using a pair of yarns threaded together through each needle 26, the pieces of yarn 14 may be placed in the carrier 10 in a space considerably smaller than the size of a latch hook rug to be made from the pieces of yarn 14.

Although the individual pieces of yarn are not fastened to the carrier 10 so securely as to prevent removal or permit use of the filled carrier 10 as a rug, the filled carrier 10 presents the pieces of yarn in a form similar to that of a finished latch hook rug, permitting a prospective buyer of a handicraft kit to preview the appearance of the various colors of yarn of the finished article, and thus to better appreciate its finished appearance.

As may be seen in FIG. 4, the individual pieces 14 of yarn may be serially removed from the carrier 10, as required to complete the design. Each yarn is then tied in place on the mesh backing material 36 to complete a latch hook rug 38, working from one side to the other, as indicated by the arrows 40 in FIG. 4. The carrier 10 may be held conveniently at hand, as on the user's lap, folded to give access to a particular row of pieces of yarn 14, during hand tying of a latch hook rug 38.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A kit including material for assembling a handmade rug and the like, comprising:

(a) mesh backing fabric for receiving a plurality of pieces of yarn to be tied thereto in making a latch hook rug and the like;

(b) a carrier consisting essentially of a pliable sheet including means defining a plurality of perforations therein for removably holding pieces of yarn; and (c) a plurality of pieces of yarn, each of said pieces of yarn being bent into a "U" shape and having each end thereof extending through a respective one of said perforations, said perforations being sufficiently small to frictionally retain said ends, thereby removably holding said pieces of yarn in said carrier, and said plurality of pieces of yarn being sufficient in number for tying to said mesh backing to complete said latch hook rug and the like.

2. The kit of claim 1, wherein said mesh backing material includes a pattern indicated thereon to guide assembly of the latch hook rug and the like.

3. The kit of claim 1, including pieces of yarn of each of a plurality of colors held in said carrier in quantities sufficient for completion of a multi-colored latch hook rug and the like.

4. A kit including material for assembling a multi-colored handmade rug and the like, comprising:

(a) mesh backing fabric for receiving a plurality of pieces of yarn to be tied thereto in making a handmade rug and the like;

(b) a carrier consisting essentially of a pliable sheet including means defining a plurality of perforations therein for removably holding pieces of yarn; and (c) a plurality of pieces of yarn, each of said pieces of yarn being bent into a "U" shape and having each end thereof extending through a respective one of said perforations, said perforations being sufficiently small to frictionally retain said ends, thereby removably holding said pieces of yarn in said carrier, and said plurality of pieces of yarn being sufficient in number in each of a sufficient number of appropriate colors for tying to said mesh backing to complete said handmade rug and the like.

5. The kit of claim 4, wherein said mesh backing material includes a pattern indicated thereon to guide assembly of the handmade rug and the like.

6. A kit including materials for assembling a multi-colored handmade rug and the like; comprising:

(a) mesh backing fabric for receiving a plurality of pieces of yarn to be tied thereto in making a handmade rug and the like;

(b) at least one carrier, each carrier consisting essentially of a pliable sheet including means defining a plurality of perforations therein for removably holding pieces of yarn; and (c) a plurality of pieces of yarn, each of said pieces of yarn being bent into a "U" shape and having each end thereof extending through a respective one of said perforations, each said perforation being sufficiently small to frictionally but removably retain said end, said at least one carrier containing a sufficient number of pieces of yarn of each of a sufficient number of appropriate colors for tying into said mesh backing to complete said handmade rug and the like.

* * * * *